US012680751B2

(12) United States Patent
Kang et al.

(10) Patent No.: US 12,680,751 B2
(45) Date of Patent: Jul. 14, 2026

(54) REFRIGERATOR

(71) Applicant: SAMSUNG ELECTRONICS CO., LTD., Suwon-si (KR)

(72) Inventors: Yonghyun Kang, Suwon-si (KR); Donghwa Kim, Suwon-si (KR); Hyoseok Noh, Suwon-si (KR); Sungcheul Park, Suwon-si (KR); Seungmin Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 106 days.

(21) Appl. No.: 18/732,398

(22) Filed: Jun. 3, 2024

(65) Prior Publication Data

US 2024/0318900 A1 Sep. 26, 2024

Related U.S. Application Data

(63) Continuation of application No. PCT/KR2022/018035, filed on Nov. 16, 2022.

(30) Foreign Application Priority Data

Jan. 12, 2022 (KR) ..... 10-2022-0004872

(51) Int. Cl.
*F25D 23/06* (2006.01)

(52) U.S. Cl.
CPC ..... *F25D 23/064* (2013.01); *F25D 23/065* (2013.01); *F25D 2327/00* (2013.01)

(58) Field of Classification Search
CPC ..... F25D 23/063; F25D 23/064; F25D 27/00; F25D 2327/001
See application file for complete search history.

(56) References Cited

U.S. PATENT DOCUMENTS 5,009,081 A * 4/1991 Kruck ..... F25D 11/00 62/449
8,117,792 B2 2/2012 Kim et al.
(Continued)

FOREIGN PATENT DOCUMENTS

CN 104344663 B 11/2016
CN 205998415 U 3/2017
(Continued)

OTHER PUBLICATIONS

International Search Report (PCT/ISA/210) issued by the International Searching Authority on Mar. 14, 2023 in corresponding International Application No. PCT/KR2022/018035.
(Continued)

*Primary Examiner* — Daniel J Rohrhoff
(74) *Attorney, Agent, or Firm* — Sughrue Mion, PLLC

(57) ABSTRACT

A refrigerator including: an inner case forming a storage compartment with an open front side and comprising a plurality of plates formed by injection molding; an outer case coupled to an outside of the inner case; and an insulation material between the inner case and the outer case. The plurality of plates includes an upper plate and a plurality of lateral plates coupled to the upper plate. The upper plate includes an upper plate body and an upper plate coupler. The each of the plurality of lateral plates includes a lateral plate body and a lateral plate coupler. The upper plate coupler includes an upward extension portion extending upward from the upper plate body and spaced from the lateral plate body. The inner case includes a groove recessed upward extending in a front and rear direction between the upward extension portion and the lateral plate body.

17 Claims, 16 Drawing Sheets

(56) References Cited

U.S. PATENT DOCUMENTS

| | | | | |
|---|---|---|---|---|
| 10,667,517 | B2 * | 6/2020 | Fischer | C07D 409/14 |
| 10,907,885 | B2 | 2/2021 | Jung et al. | |
| 2007/0001563 | A1 | 1/2007 | Park et al. | |
| 2010/0264782 | A1 | 10/2010 | Betto et al. | |
| 2016/0282035 | A1 | 9/2016 | Sul et al. | |
| 2017/0059229 | A1 * | 3/2017 | Seo | F25D 23/064 |
| 2018/0187957 | A1 * | 7/2018 | Jung | F25D 23/062 |
| 2019/0339003 | A1 * | 11/2019 | Signorino | F25D 27/00 |
| 2023/0080310 | A1 * | 3/2023 | Kang | F25D 23/064 312/401 |
| 2023/0258391 | A1 | 8/2023 | Park et al. | |
| 2024/0085098 | A1 * | 3/2024 | You | F25D 27/00 |
| 2024/0200858 | A1 * | 6/2024 | Cho | F25D 21/14 |
| 2024/0310111 | A1 * | 9/2024 | Park | F25D 23/06 |
| 2025/0052482 | A1 * | 2/2025 | Jeong | F25D 23/063 |

FOREIGN PATENT DOCUMENTS

| | | | | |
|---|---|---|---|---|
| CN | 206891004 | U | 1/2018 | |
| CN | 207778936 | U | 8/2018 | |
| DE | 102019213446 | A1 | 3/2021 | |
| EP | 4332477 | A1 * | 3/2024 | F25D 23/063 |
| JP | 3689253 | B2 | 8/2005 | |
| JP | 3709958 | B2 | 10/2005 | |
| JP | 4270325 | B1 | 5/2009 | |
| JP | 2009-228948 | A | 10/2009 | |
| KR | 20-1998-0013810 | U | 6/1998 | |
| KR | 10-0186124 | B1 | 4/1999 | |
| KR | 20-2000-0001436 | U | 1/2000 | |
| KR | 20-0424923 | Y1 | 8/2006 | |
| KR | 10-0700612 | B1 | 3/2007 | |
| KR | 10-2017-0010529 | A | 2/2017 | |
| KR | 10-2018-0080054 | A | 7/2018 | |
| KR | 10-2022-0085720 | A | 6/2022 | |

OTHER PUBLICATIONS

Written Opinion (PCT/ISA/237) issued by the International Searching Authority on Mar. 14, 2023 in corresponding International Application No. PCT/KR2022/018035.

Communication dated Feb. 3, 2025 issued by the European Patent Office in European Patent Application No. 22920777.4.

* cited by examiner

REFRIGERATOR

CROSS-REFERENCE TO RELATED APPLICATIONS

This application is a continuation of International Application No. PCT/KR2022/018035, filed on Nov. 16, 2022, which is based on and claims priority to Korean Patent Application No. 10-2022-0004872, filed on Jan. 12, 2022, in the Korean Intellectual Property Office, the disclosures of which are incorporated by reference herein in their entireties.

BACKGROUND

1. Field

The present disclosure relates to a refrigerator, and more particular, to a refrigerator including an inner case formed by assembling a plurality of plates formed by injection molding.

2. Description of the Related Art

A refrigerator is a device that is composed of a main body including a storage compartment, and a cold air supply system configured to supply cold air to the storage compartment to keep food fresh. The storage compartment includes a refrigerating compartment maintained at approximately 0° C. to 5° C. to store food in a refrigerated manner, and a freezing compartment maintained at approximately 0° C. to −30° C. to store food in a frozen manner. The storage compartment is provided to be open to the front for food entry and exit, and the storage compartment is opened and closed by a door.

An inner case and an outer case are coupled to each other to form the main body of the refrigerator. The inner case forms the storage compartment, and the outer case forms the exterior of the refrigerator. An insulation material for thermal insulation is arranged between the inner case and the outer case.

Generally, the inner case of the refrigerator is manufactured as one piece in a vacuum forming process. That is, the inner case may be formed such that a sheet of resin material is heated and the stretched sheet is put on a mold, and air is suctioned against the mold. When forming the inner case using the vacuum forming process, it is required for various accessories attached to the inner case to be separately molded and assembled into the inner case, and because the inner case has a large size, transportation and storage of the inner case is difficult.

SUMMARY

Additional aspects will be set forth in part in the description which follows and, in part, will be apparent from the description, or may be learned by practice of the presented embodiments.

According to an aspect of the disclosure, provided is a refrigerator including an inner case formed by assembling a plurality of plates formed by injection molding.

According to another aspect of the disclosure, provided is an improved appearance design for the refrigerator by concealing boundaries between a plurality of plates by a coupling line between a plurality of plates is not exposed to the user's field of view.

According to an aspect of the disclosure, a refrigerator includes: an inner case forming a storage compartment with an open front side and including a plurality of plates formed by injection molding; an outer case coupled to an outside of the inner case; and an insulation material between the inner case and the outer case. The plurality of plates includes an upper plate and a plurality of lateral plates coupled to the upper plate. The upper plate includes an upper plate body and an upper plate coupler on an edge of the upper plate body. Each of the plurality of lateral plates includes a lateral plate body and a lateral plate coupler on an edge of the lateral plate body and configured to be coupled to the upper plate coupler. The upper plate coupler includes an upward extension portion extending upward from the upper plate body and spaced from the lateral plate body by a predetermined distance. The inner case includes a groove recessed upward extending in a front and rear direction between the upward extension portion and the lateral plate body.

The groove may extend rearward from a first point, the first point being spaced in a rear direction from a front surface of the inner case by a first predetermined length.

The refrigerator may further include a section between the front surface of the inner case and a second point, the second point being spaced in the rear direction from the front surface of the inner case by a second predetermined length. The upper plate body and the lateral plate body may contact each other at the section. An angle may be formed between the upper plate body and the lateral plate body at the section.

The upper plate coupler may include an insertion protrusion protruding from the upward extension portion toward the plurality of lateral plates. The lateral plate coupler may include an insertion groove into which the insertion protrusion is inserted.

The lateral plate coupler may include an upper protrusion protruding from the lateral plate body toward the upper plate, and a lower protrusion protruding from the lateral plate body toward the upper plate and located below the upper protrusion. The insertion groove may be formed between the upper protrusion and the lower protrusion.

The upper plate coupler may include a locking protrusion protruding from the insertion protrusion in a direction perpendicular to an insertion direction of the insertion protrusion. The lateral plate coupler may include a locking portion configured to lock the locking protrusion thereto.

The lateral plate coupler may include an elastic bracket on which the locking portion is formed, and one or more slits formed on both sides of the elastic bracket and may be configured to allow the elastic bracket to be elastically deformed.

The groove may include a depth having a length between an open lower side of the groove and the lower protrusion, and a width having a length between the upward extension portion and the lateral plate body. The depth of the groove may be greater than or equal to the width of the groove.

A left side of the lamp accommodating space and a right side of the lamp accommodating space may be open.

The plurality of lateral plates may include a left plate and a right plate. The left side of the lamp accommodating space may be covered by the left plate, and the right side of the lamp accommodating space may be covered by the right plate.

The groove and the lamp accommodating space may be connected to each other.

A lower side of the lamp accommodating space may be open. The refrigerator may further include a lamp cover configured to cover the open lower side of the lamp accommodating space.

The lamp cover may include a cover body forming the same plane as the inner surface of the upper plate, and a cover protrusion protruding from the cover body toward the lamp accommodating space. The upper plate may include a mounting protrusion formed in the lamp accommodating space and may be configured to allow the cover protrusion to be coupled thereto.

The refrigerator may further include a side lamp arranged inside the groove and may be configured to illuminate the storage compartment.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

The various embodiments and the terms used therein are not intended to limit the technology disclosed herein to specific forms, and the disclosure should be understood to include various modifications, equivalents, and/or alternatives to the corresponding embodiments.

The singular forms "a," "an," and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Figure 1:
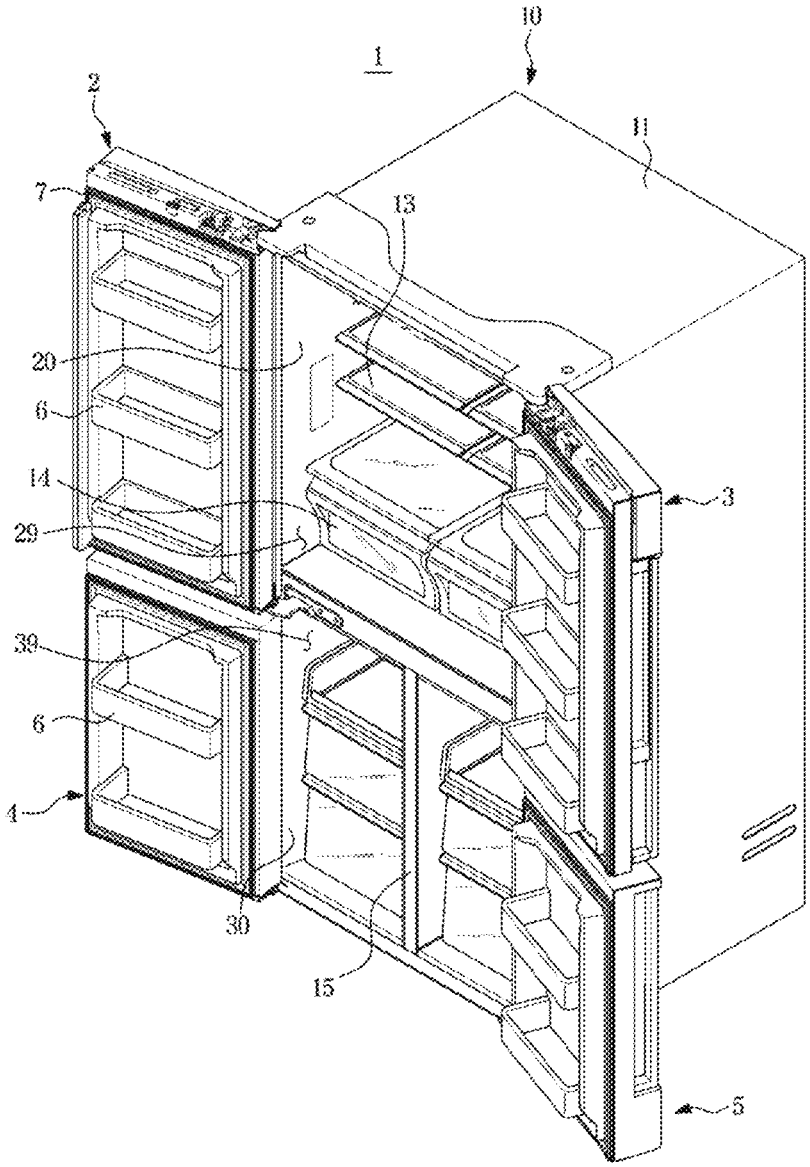
FIG. 1 is a view illustrating an exterior of a refrigerator according to one or more embodiments.
Figure 2:
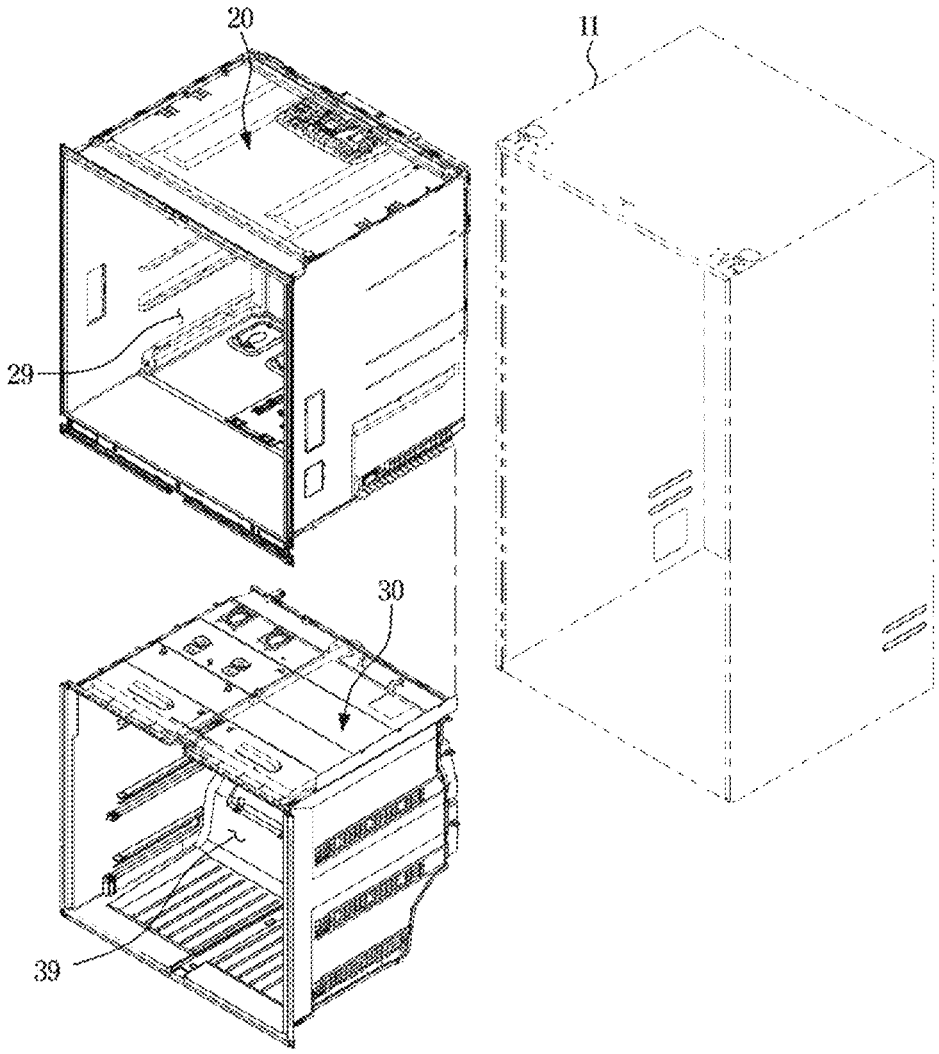
FIG. 2 is a view illustrating a state in which a first inner case, a second inner case, and an outer case are separated from each other in the refrigerator one or more embodiments.

Hereinafter various embodiments of the present disclosure will be described in detail with reference to the accompanying drawings FIG. 1 is a view illustrating an exterior of a refrigerator according to one or more embodiments. FIG. 2 is a view illustrating a state in which a first inner case, a second inner case, and an outer case are separated from each other in the refrigerator according to one or more embodiments.

Referring to FIGS. 1 and 2, a refrigerator 1 may include a main body 10, storage compartments 29 and 39 formed inside the main body 10, doors 2, 3, 4, and 5 configured to open and close the storage compartments 29 and 39, and a cold air supply device configured to supply cold air to the storage compartments 29 and 39.

The main body 10 may include inner cases 20 and 30 forming the storage compartments 29 and 39, an outer case 11 coupled to an outside of the inner cases 20 and 30 to form an external appearance, and an insulation material 12 (refer to FIG. 7) foamed between the inner cases 20 and 30 and the outer case 11 to thermally insulate the storage compartments 29 and 39.

The cold air supply device may be configured to generate cold air by using a refrigeration circulation cycle that compresses, condenses, expands and evaporates a refrigerant. Accordingly, the cold air supply device may supply the cold air to the storage compartments 29 and 39.

The inner cases 20 and 30 may include a first inner case 20 and a second inner case 30. The first inner case 20 and the second inner case 30 may be manufactured separately and assembled together. The first inner case 20 and the second inner case 30 may each have a box shape with an open front side.

A first storage compartment 29 may be formed inside the first inner case 20, and a second storage compartment 39 may be formed inside the second inner case 30. The first storage compartment 29 may be used as a refrigerating compartment and the second storage compartment 39 may be used as a freezing compartment. The second storage compartment 39 may be divided into a plurality of spaces by a vertical partition 15. The vertical partition 15 may be manufactured separately from the second inner case 30 and may be coupled to the second inner case 30. However, the division and use of the storage compartments 29 and 39 as described above is not limited thereto.

The first inner case 20 may be located in an upper part of the main body 10, and the second inner case 30 may be located in a lower part of the main body 10. However, the positions of the first inner case 20 and the second inner case 30 are not limited thereto, and the first inner case 20 and the second inner case 30 may be arranged in left and right directions.

In the storage compartments 29 and 39, a shelf 13 on which food is placed and a storage container 14 in which food is stored may be provided.

The first storage compartment 29 may be opened and closed by a pair of doors 2 and 3. The doors 2 and 3 may be rotatably coupled to the main body 10. The second storage compartment 39 may be opened and closed by doors 4 and 5, and the doors 4 and 5 may be rotatably coupled to the main body 10. A door shelf 6 in which food is stored may be provided on a rear surface of the doors 2, 3, 4, and 5. A gasket 7 provided to be in close contact with the front of the main body 10 may be provided on a rear edge of the doors 2, 3, 4, and 5 to seal the storage compartments 29 and 39.

Figure 3:
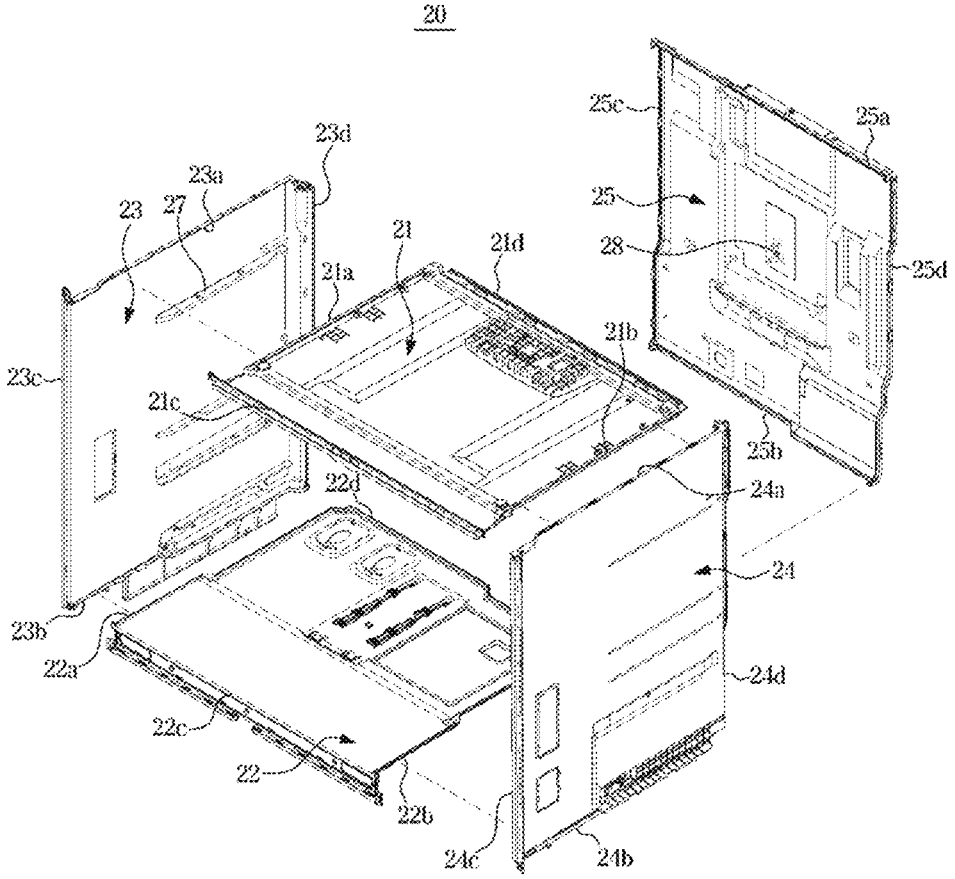
FIG. 3 is an exploded view of the first inner case one or more embodiments.

FIG. 3 is an exploded view of the first inner case according to one or more embodiments.

The first inner case 20 according to one or more embodiments will be described with reference to FIG. 3. Because there is substantially no significant difference in the structures of the first inner case 20 and the second inner case 30, a description of the second inner case 30 will be omitted. A description of the first inner case 20 may be equally applied to the second inner case 30.

The first inner case 20 may include a plurality of plates 21, 22, 23, 24, and 25. The first inner case 20 may be formed by coupling the plurality of plates 21, 22, 23, 24, and 25. The plurality of plates 21, 22, 23, 24, and 25 may be coupled to each other without separate fastening members. That is, each of the plurality of plates 21, 22, 23, 24, and 25 may include a coupler for mutual coupling. The coupler may include a fitting structure and/or a locking structure.

The plurality of plates 21, 22, 23, 24, and 25 may each be formed of a resin material by an injection molding. The plurality of plates 21, 22, 23, 24, and 25 may include an upper plate 21, a lower plate 22, a left plate 23, a right plate 24, and a rear plate 25.

The upper plate 21 may form an upper surface of the storage compartment 29. The lower plate 22 may form a lower surface of the storage compartment 29. The left plate 23 may form a left surface of the storage compartment 29. The right plate 24 may form a right surface of the storage compartment 29. The rear plate 25 may form a rear surface of the storage compartment 29.

A rail 27 provided to slidably support the storage container 14 may be formed on an inner side of the left plate 23 and the right plate 24. A fixer 28 provided to fix an evaporator may be formed on an inner side of the rear plate 25.

Each of the plurality of plates 21, 22, 23, 24, and 25 may include four edges.

The upper plate 21 may include a left edge 21*a*, a right edge 21*b*, a front edge 21*c*, and a rear edge 21*d*.

The lower plate 22 may include a left edge 22*a*, a right edge 22*b*, a front edge 22*c*, and a rear edge 22*d*.

The left plate 23 may include an upper edge 23*a*, a lower edge 23*b*, a front edge 23*c*, and a rear edge 23*d*.

The right plate 24 may include an upper edge 24*a*, a lower edge 24*b*, a front edge 24*c*, and a rear edge 24*d*.

The rear plate 25 may include an upper edge 25*a*, a lower edge 25*b*, a left edge 25*c*, and a right edge 25*d*.

The left edge 21*a* of the upper plate 21 and the upper edge 23*a* of the left plate 23 may be coupled.

The right edge 21*b* of the upper plate 21 and the upper edge 24*a* of the right plate 24 may be coupled.

The rear edge 21*d* of the upper plate 21 and the upper edge 25*a* of the rear plate 25 may be coupled.

The left edge 22*a* of the lower plate 22 and the lower edge 23*b* of the left plate 23 may be coupled.

The right edge 22*b* of the lower plate 22 and the lower edge 24*b* of the right plate 24 may be coupled.

The rear edge 22*d* of the lower plate 22 and the lower edge 25*b* of the rear plate 25 may be coupled.

The rear edge 23*d* of the left plate 23 and the left edge 25*c* of the rear plate 25 may be coupled.

The rear edge 24*d* of the right plate 24 and the right edge 25*d* of the rear plate 25 may be coupled.

As described above, the first inner case 20 may be formed by coupling the edges of the plurality of plates 21, 22, 23, 24, and 25, and may include eight coupling points.

Because the plurality of plates 21, 22, 23, 24, and 25 are coupled to each other as mentioned above, a coupling line may be formed between the plurality of plates 21, 22, 23, 24, and 25. Because the storage compartment 29 is maintained at a low temperature, the plurality of plates 21, 22, 23, 24, and 25 may be deformed by heat shrinkage due to the low temperature. In this case, a gap or a step difference may occur between the plurality of plates 21, 22, 23, 24, and 25 and the gap or the step difference between the plurality of plates 21, 22, 23, 24, and 25 may allow the coupling lines between the plates 21, 22, 23, 24, and 25 to be noticeable and may cause a decrease in appearance quality.

Particularly, the coupling line of an upper left corner and an upper right corner of the first inner case 20 disposed on the upper part of the main body 10 is at an angle that may be easily noticed by a user. That is, the coupler between the upper plate 21 and the left plate 23 of the first inner case 20 and the coupler between the upper plate 21 and the right plate 24 of the first inner case 20 may be easily noticed by a user.

According to one or more embodiments, a groove 100 (refer to FIGS. 7 to 10) may be formed between the upper plate 21 and the left plate 23 and between the upper plate 21 and the right plate 24 so as to allow the coupler between the upper plate 21 and the left plate 23 and the coupler between the upper plate 21 and the right plate 24 to be hidden from the user's field view. Hereinafter a coupling structure between the upper plate 21 and the left plate 23 and between the upper plate 21 and the right plate 24 and a structure of the groove 100 will be described.

Figure 4:
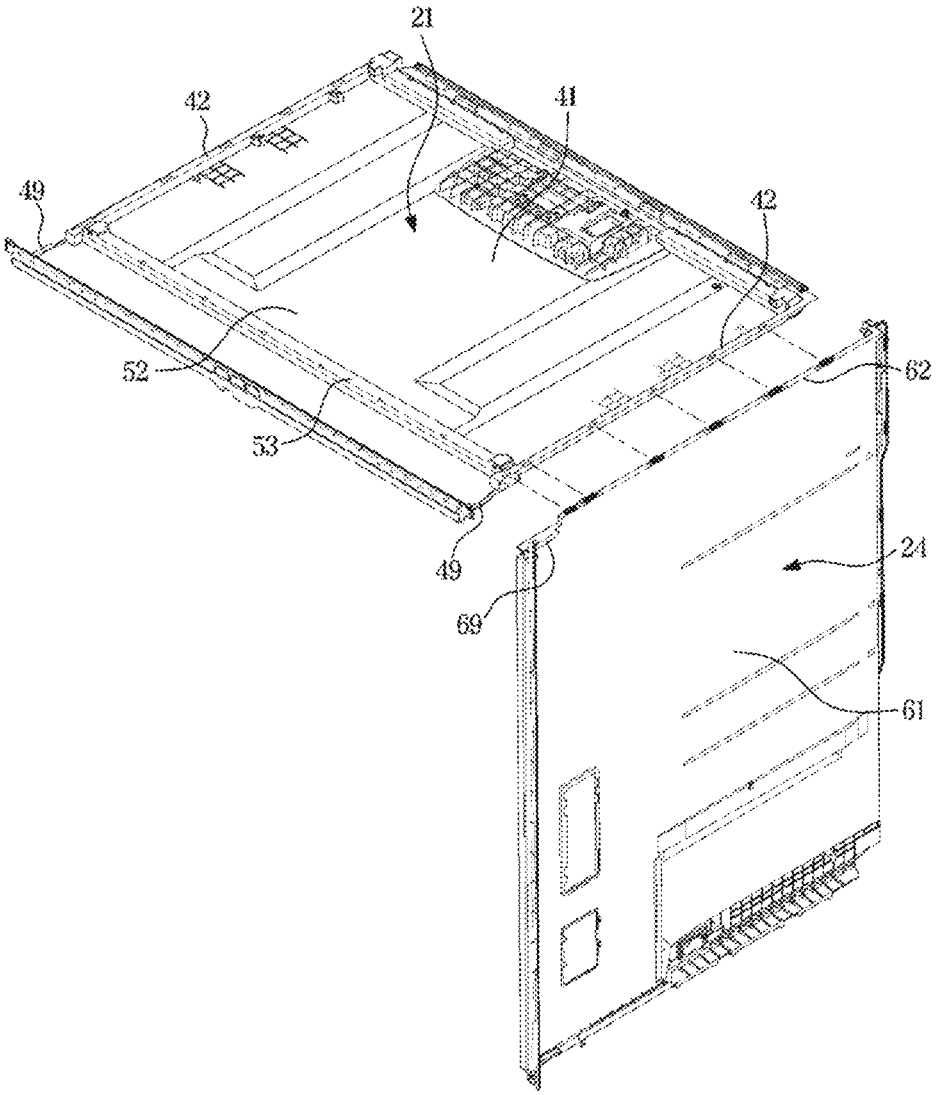
FIG. 4 is a view illustrating an upper plate and a right plate one or more embodiments.
Figure 5:
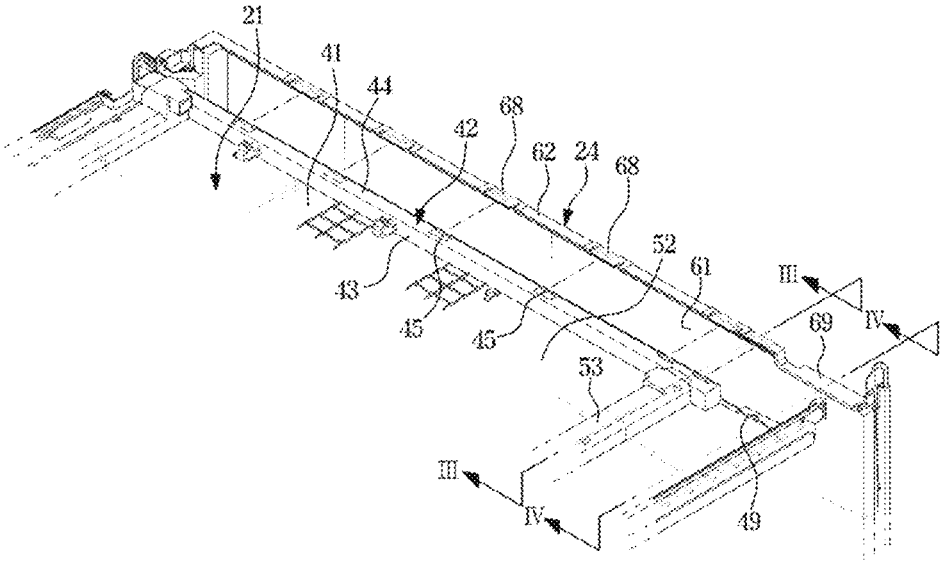
FIG. 5 is a view illustrating the upper plate and the right plate one or more embodiments.
Figure 6:
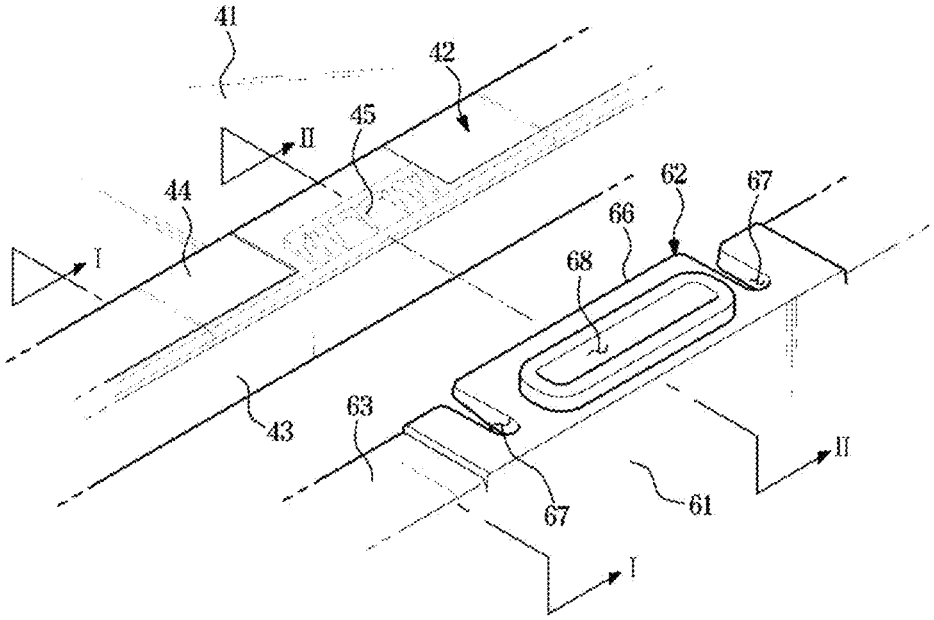
FIG. 6 is an enlarged view illustrating a coupler of the upper plate and the right plate one or more embodiments.
Figure 7:
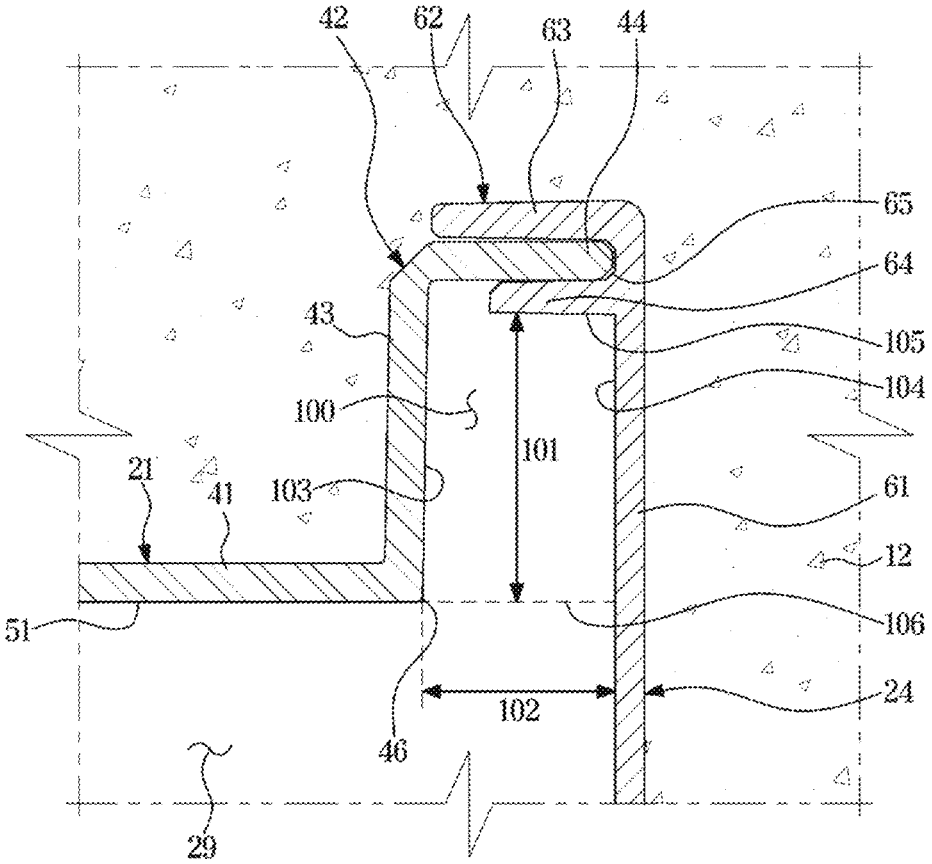
FIG. 7 is a cross-sectional view taken along a line I-I of FIG. 6.
Figure 8:
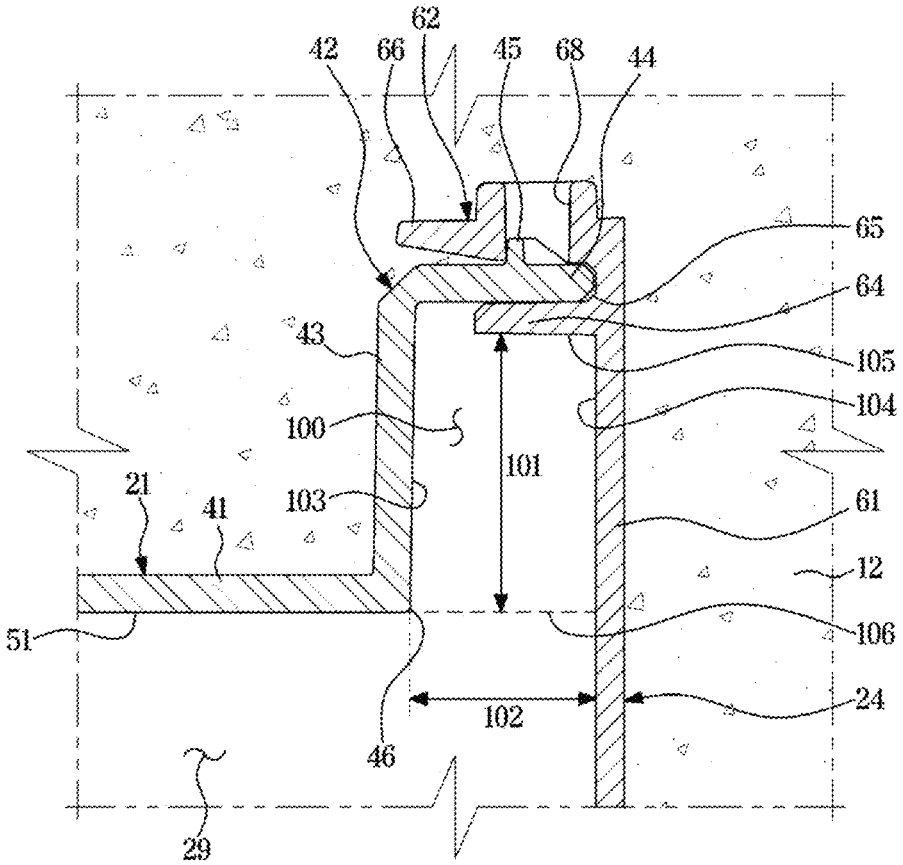
FIG. 8 is a cross-sectional view taken along a line II-II of FIG. 6.

FIG. 4 is a view illustrating an upper plate and a right plate one or more embodiments. FIG. 5 is a view illustrating the upper plate and right plate one or more embodiments when viewed from different angles. FIG. 6 is an enlarged view illustrating a coupler of the upper plate and the right plate one or more embodiments. FIG. 7 is a cross-sectional view taken along a line I-I of FIG. 6. FIG. 8 is a cross-sectional view taken along a line II-II of FIG. 6.

The coupling structure of the upper plate 21 and the right plate 24, and the groove 100 will be described with reference to FIGS. 4 through 8. The coupling structure of the upper plate 21 and the left plate 23 may be substantially the same as the coupling structure of the upper plate 21 and the right plate 24. Therefore, the coupling structure of the upper plate 21 and the right plate 24, and the structure of the groove 100 formed between the upper plate 21 and the right plate 24 described below may be applied to the coupling structure of the upper plate 21 and the left plate 23, and the structure of the groove formed between the upper plate 21 and the left plate 23. Further, hereinafter the term "lateral plate" may be used to include the left plate and the right plate.

When the upper plate 21 and the right plate 24 are coupled, the upper plate 21 and the right plate 24 may be substantially perpendicular to each other.

The upper plate 21 may include an upper plate body 41 and an upper plate coupler 42 provided on a right edge of the upper plate body 41. The upper plate body 41 and the upper plate coupler 42 may be injection molded as one piece. An inner surface 51 of the upper plate body 41 may form an upper side of the storage compartment 29, and an outer surface 52 of the upper plate body 41 may be in contact with the insulation material 12.

The upper plate coupler 42 may be provided on at least a portion of the right edge of the upper plate body 41. The upper plate coupler 42 may be coupled to a lateral plate coupler 62 of the right plate 24. The upper plate coupler 42 may be coupled to the lateral plate coupler 62 in a fitting and locking manner.

The right plate 24 may include a lateral plate body 61 and the lateral plate coupler 62 provided on an upper edge of the lateral plate body 61. The lateral plate body 61 and the lateral plate coupler 62 may be injection molded as one piece. An inner surface of the lateral plate body 61 may form a right side of the storage compartment 29, and an outer surface of the lateral plate body 51 may be in contact with the insulation material 12.

The upper plate coupler 42 may include an upward extension portion 43 provided to extend upward from the upper plate body 41 and spaced apart from the lateral plate body 61. The upward extension portion 43 may be arranged parallel to the lateral plate body 61. The upward extension portion 43 may extend perpendicular from the upper plate body 41. The upward extension portion 43 may extend in the front and rear direction along the right edge 21*b* of the upper plate 21.

The upward extension portion 43 may extend upward from the right edge of the upper plate body 41 and may be spaced apart from the lateral plate body 61. Accordingly, the upper plate body 41 may also be spaced apart from the lateral plate body 61.

The upper plate coupler 42 may include an insertion protrusion 44 protruding from the upward extension portion 43 toward the right plate 24. The insertion protrusion 44 may extend perpendicular to the upward extension portion 43. The insertion protrusion 44 may be parallel to the upper plate body 21. The insertion protrusion 44 may be inserted into an insertion groove 65 of the lateral plate coupler 62. The insertion protrusion 44 may be inserted into the insertion groove 65 to allow the upper plate 21 and the right plate 24 to be coupled to each other. The insertion protrusion 44 may extend along the right edge 21*b* of the upper plate 21.

The lateral plate coupler 62 may include an upper protrusion 63 protruding from the lateral plate body 61 toward the upper plate 21, and a lower protrusion 64 protruding from the lateral plate body 61 toward the upper plate 21 and positioned below the upper protrusion 63. The upper protrusion 63 and the lower protrusion 64 may extend perpendicular to the lateral plate body 61. The insertion groove 65 may be formed between the upper protrusion 63 and the lower protrusion 64. The upper protrusion 63, the lower protrusion 64, and the insertion groove 65 may extend in the front and rear direction along the upper edge 24*a* of the right plate 24.

The upper plate coupler 42 may include a locking protrusion 45 protruding from the insertion protrusion 44 toward a direction perpendicular to an insertion direction of the insertion protrusion 44.

The lateral plate coupler 62 may include a locking portion 68 provided to prevent the insertion protrusion 44 from separating from the insertion groove 65 when the insertion protrusion 44 is inserted into the insertion groove 65. The locking portion 68 may be formed in a hole shape to allow the locking protrusion 45 to be locked thereto. According to one or more embodiments, the locking portion 68 may be formed in the form of a groove or in the form of a protrusion corresponding to the locking protrusion.

The lateral plate coupler 62 may include an elastic bracket 66 on which the locking portion 68 is formed. The elastic bracket 66 may be formed by being bent from the lateral plate body 61. A portion of the upper protrusion 63 may be cut out, and the elastic bracket 66 may be placed in the cut portion. A slit 67 may be formed on both sides of the elastic bracket 66 to allow the elastic bracket 66 to be smoothly elastically deformed.

While the insertion protrusion 44 is inserted into the insertion groove 65, the elastic bracket 66 may be pressed against the locking protrusion 45 and elastically deformed in an unfolding direction. When the insertion protrusion 44 is completely inserted into the insertion groove 65, the elastic bracket 66 may move to an original state thereof and the locking protrusion 45 may be locked to the locking portion 68.

When the upper plate coupler 42 and the lateral plate coupler 62 are coupled, the groove 100 may be formed between the upper plate 21 and the right plate 24. Particularly, the groove 100 may be formed to be recessed upward between the upward extension portion 43 of the upper plate 21 and the lateral plate body 61 of the right plate 24. The groove 100 may be formed to extend in the front and rear direction between the upward extension portion 43 and the lateral plate body 61.

The upper body 41 and the upward extension portion 43 may be spaced apart from the lateral plate body 61 by the groove 100, and the upper plate coupler 42 and the lateral plate coupler 62 may be hidden from the user's field view.

Because the upper plate coupler 42 and the lateral plate coupler 62 are hidden from the user's field view, the coupling line of the upper plate 21 and the right plate 24 may be hidden from the user's field view. That is, an actual coupling line of the upper plate 21 and the right plate 24 may be hidden from the user's field of view, and a corner 46 between the upper plate body 41 and the upper plate coupler 42 may be exposed to the user's field of view. A user cannot be aware of the existence of the groove 100, and the corner 46 between the upper plate body 41 and the upper plate coupler 42 may be recognized by the user as the corner of the upper plate 21 and the right plate 24.

The actual coupling line of the upper plate 21 and the right plate 24 may include a step difference or a gap due to heat shrinkage and deformation caused by the low temperature of the storage compartment 29. However, the corner 46 between the upper plate body 41 and the upper plate coupler 42 may have a straight-line shape. Accordingly, the appearance design may be improved.

A left surface 103 of the groove 100 may be formed by an inner surface of the upward extension portion 43, a right surface 104 of the groove 100 may be formed by an inner surface of the lateral plate body 61, and an upper surface 105 of the groove 100 may be formed by the lower protrusion 64 and the insertion protrusion 44. A lower side 106 of the groove 100 may be open.

The groove 100 may have a depth 101 of the groove 100 corresponding to a length between the open lower side 106 and the lower protrusion 64, and a width 102 of the groove 100 corresponding to a length between the upward extension portion 43 and the lateral plate body 61. The depth 101 of the groove 100 may correspond to or be greater than the width 102 of the groove 100.

The depth 101 of the groove 100 may correspond to or be greater than the width 102 of the groove 100, as mentioned above, and thus a viewing angle at which the coupling line of the upper plate 21 and the right plate 24 is concealed may be increased and the coupling line of the upper plate 21 and the right plate 24 may be more effectively concealed.

Figure 9:
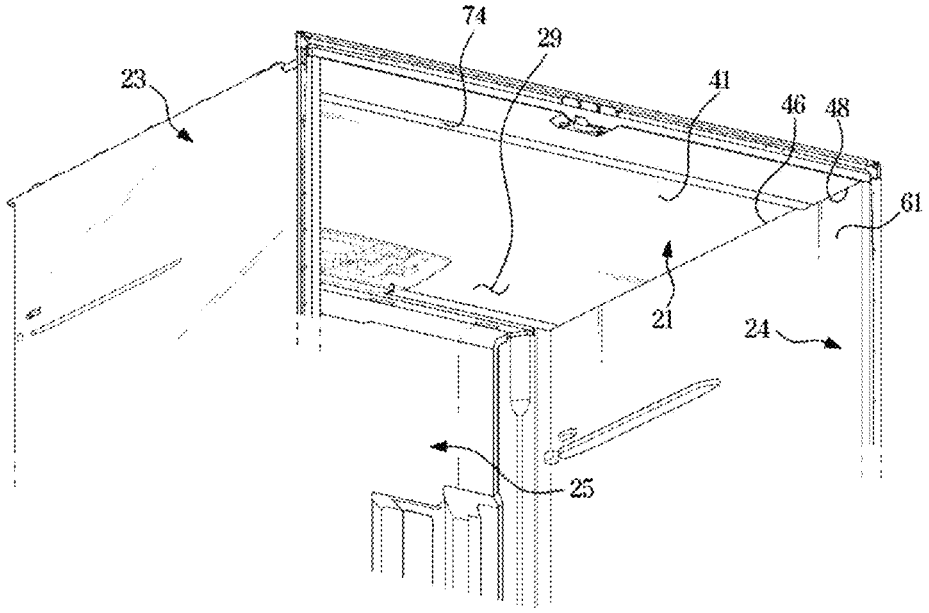
FIG. 9 is a view of the inner case one or more embodiments.
Figure 10:
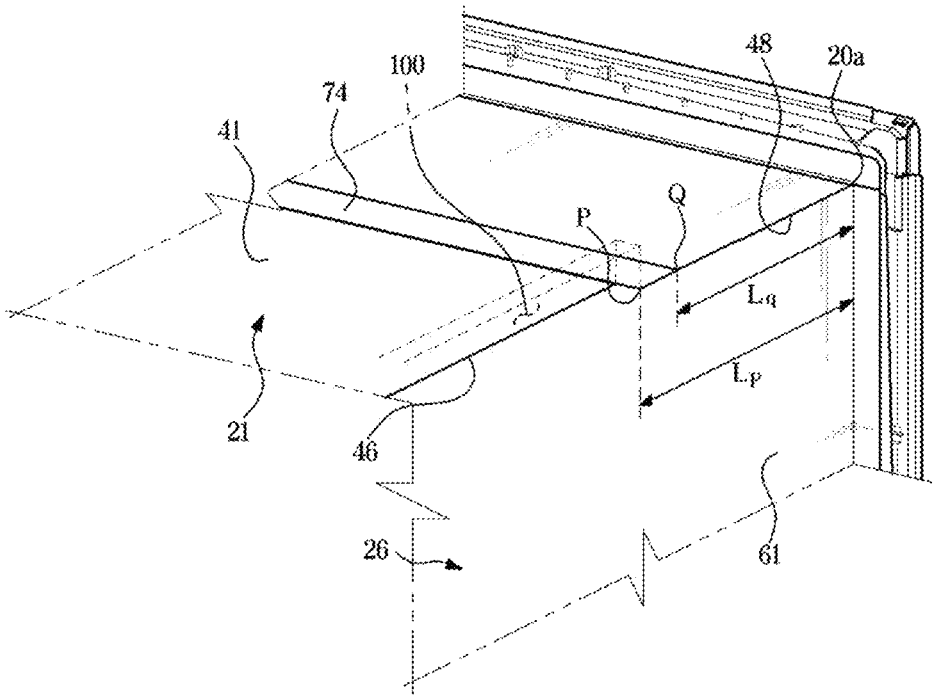
FIG. 10 is a view illustrating a groove one or more embodiments.
Figure 11:
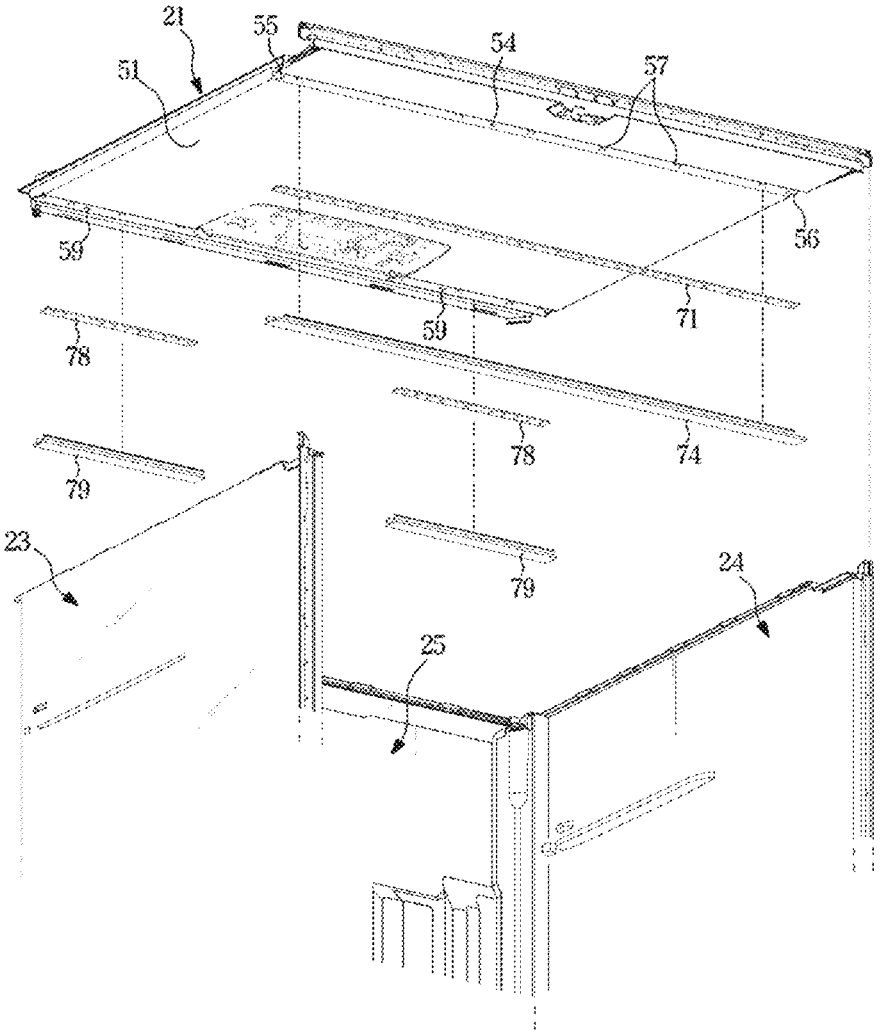
FIG. 11 is a view illustrating a structure in which a lamp is coupled to the upper plate one or more embodiments.
Figure 12:
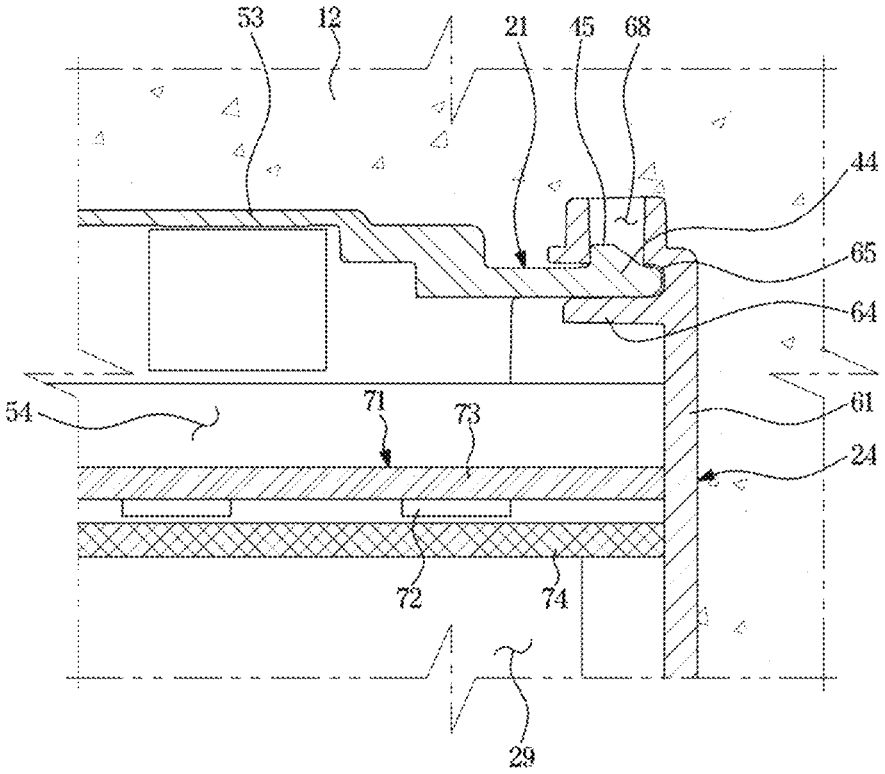
FIG. 12 is a cross-sectional view taken along a line III-III in FIG. 5.
Figure 13:
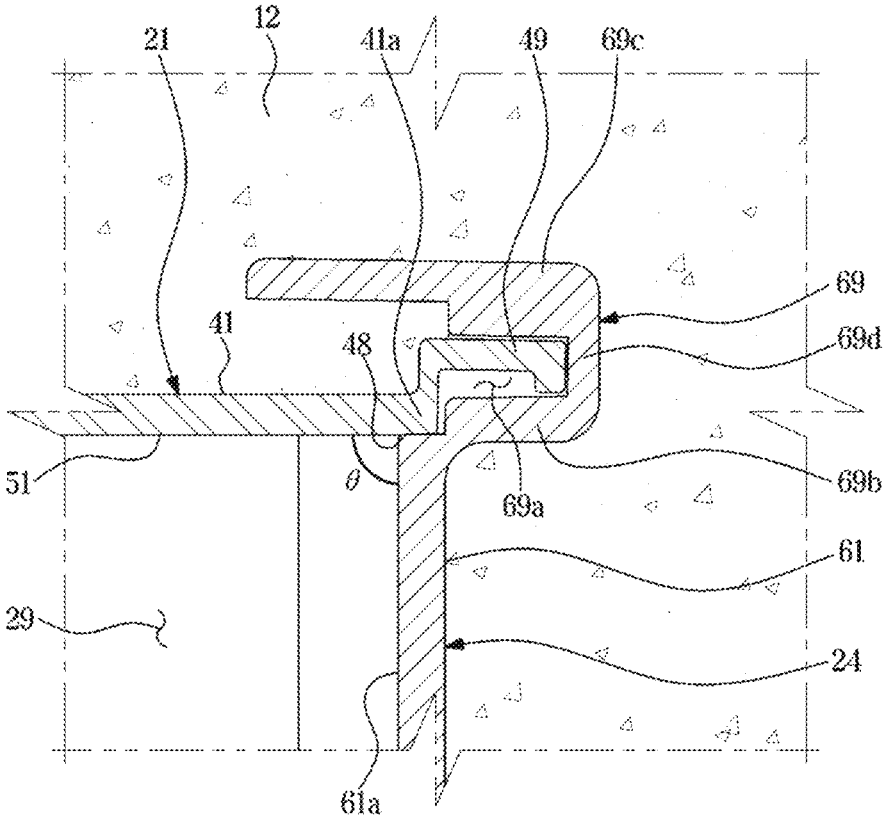
FIG. 13 is a cross-sectional view taken along a line IV-IV of FIG. 5.
Figure 14:
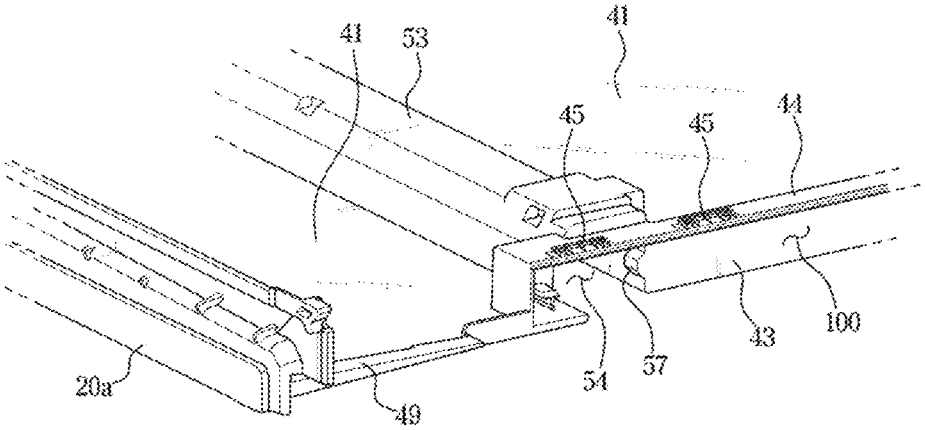
FIG. 14 is a view illustrating a lamp accommodating space of the upper plate one or more embodiments.
Figure 15:
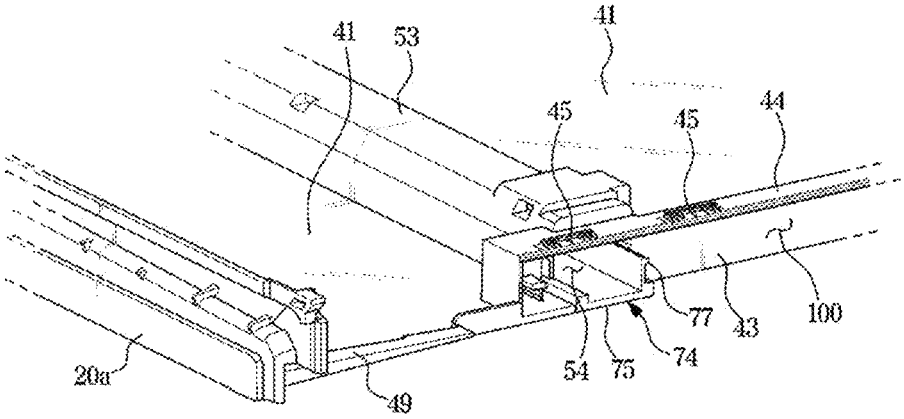
FIG. 15 is a view illustrating a state in which a lamp cover is coupled to the lamp accommodating space of FIG. 14.
Figure 16:
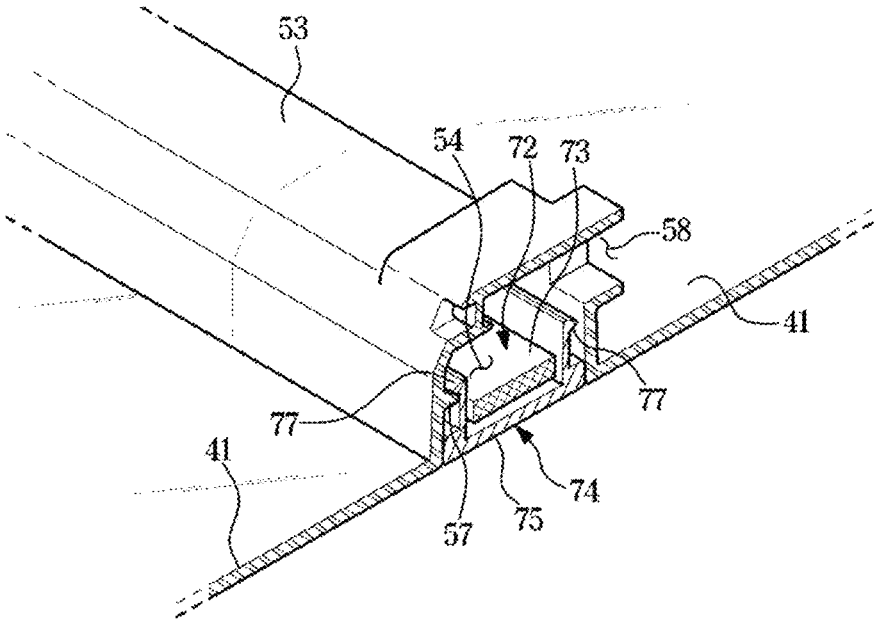
FIG. 16 is a cross-sectional view of the lamp accommodating space of the upper plate one or more embodiments.

FIG. 9 is a view of the inner case one or more embodiments when viewed obliquely from below. FIG. 10 is a view illustrating a groove one or more embodiments. FIG. 11 is a view illustrating a structure in which a lamp is coupled to the upper plate one or more embodiments. FIG. 12 is a cross-sectional view taken along a line III-III in FIG. 5. FIG. 13 is a cross-sectional view taken along a line IV-IV of FIG. 5. FIG. 14 is a view illustrating a lamp accommodating space of the upper plate one or more embodiments. FIG. 15 is a view illustrating a state in which a lamp cover is coupled to the lamp accommodating space of FIG. 14. FIG. 16 is a cross-sectional view of the lamp accommodating space of the upper plate one or more embodiments.

Referring to FIGS. 9 through 16, the groove 100 may be formed to extend rearward from a point P that is spaced rearward from a front surface 20*a* of the inner case 20 by a predetermined length Lp. That is, the groove 100 may not be formed from the front surface 20*a* of the inner case 20 to the point P. This is because, when the groove 100 is formed from the front surface 20*a*, the groove 100 may be easily recognized by a user and the aesthetics may be reduced.

The length Lp from the point P at which the groove 100 starts may be less than half a distance from the front surface 20*a* to the rear surface of the inner case 20.

In a section between the front surface 20*a* of the inner case 20 and a point Q that is spaced rearward from the front surface 20*a* of the inner case 20 by a predetermined length Lq, the upper plate body 41 and the lateral plate body 61 may be in contact with each other.

Particularly, as shown in FIG. 13, a portion 41*a* of the upper plate body 41 may be located outside an inner surface 61*a* of the lateral plate body 61, and the portion 41*a* of the upper plate body 41 may be in contact with an upper end of the lateral plate body 61.

In the section between the front surface 20*a* of the inner case 20 and the point Q, an angle θ may be formed between the upper plate body 41 and the lateral plate body 61. The angle θ may be a right angle (i.e. a 90° angle). That is, an angled corner 48 may be formed between the upper plate body 41 and the lateral plate body 61.

The angled corner 48 between the upper plate body 41 and the lateral plate body 61 may correspond to the corner 46 between the upper plate body 41 and the upward extension portion 43, thereby creating a harmonious and unified design. The corner 48 formed by the upper plate body 41 and the lateral plate body 61 may be formed parallel to the corner 46 between the upper plate body 41 and the upward extension portion 43.

The upper plate 21 may include an upper plate front coupler 49 provided in front of the upper plate coupler 42, and the right plate 24 may include a lateral plate front coupler 69 provided in front of the lateral plate coupler 62.

The upper plate front coupler 49 may be formed to protrude from the upper plate body 41 toward the lateral plate 61, and at least a portion of the upper plate front coupler 49 may be in contact with the lateral plate body 61 or be located further outside than the inner surface 61*a* of the lateral plate body 61.

The lateral plate front coupler 69 may include an insertion groove 69*a* provided to accommodate the upper plate front coupler 49. The lateral plate front coupler 69 may include a first wall 69*b* extending from the lateral plate body 61 to the outside in which the insulating material 12 is located, a second wall 69*c* facing the first wall 69*b*, and a third wall 69*d* connecting the first wall 69*b* and the second wall 69*c*. The insertion groove 69*a* may be formed by the first wall 69*b*, the second wall 69*c*, and the third wall 69*d*.

A lamp 71 configured to illuminate the storage compartment 29 may be provided in a section between the points P and Q. The lamp 71 may include a light source 72, such as an LED, and a substrate 73 on which the light source 72 is mounted.

The upper plate 21 may include a lamp accommodating space 54 recessed on the inner surface 51 of the upper plate 21 to accommodate the lamp 71, and the lamp accommodating space 54 may be formed in the section between the points P and Q. The upper plate 21 may include a lamp accommodating portion 53 protruding from the outer surface 52 of the upper plate 21 to form the lamp accommodating space 54. A wire hole 58 may be formed in the lamp accommodating portion 53 to connect an electric wire to the lamp 71, which is located in the lamp accommodating space 54, from the outside of the inner case 20.

As illustrated in FIG. 11, the lamp accommodating space 54 may extend long in the left and right direction in the section between the points P and Q. That is, the lamp accommodating space 54 may extend from the left plate 23 to the right plate 24. A left side 55 and a right side 56 of the lamp accommodating space 54 may be open, and the open left side 55 and the open right side 56 may be covered by the left plate 23 and the right plate 24, respectively.

A lower side of the lamp accommodating space 54 may be open, and the open lower side of the lamp accommodating space 54 may be covered by a lamp cover 74. The lamp cover 74 may protect the lamp 71 disposed in the lamp accommodating space 54. The lamp cover 74 may form a portion of the upper portion of the storage compartment 29.

The lamp cover 74 may be coupled to the upper plate 21. The lamp cover 74 may include a cover body 75 forming the same plane as the inner surface 51 of the upper plate 21, and a cover protrusion 77 protruding from the cover body 75 toward the lamp accommodating space 54. The cover body 75 may be formed of a transparent, translucent or fluorescent material to allow light emitted from the lamp 71 to pass through. The cover protrusion 77 may be coupled to a mounting protrusion 57 formed in the lamp accommodating space 54. The lamp 71 may be attached to the lamp cover 74 or one surface of the lamp accommodating space 54.

The groove 100 may be connected to the lamp accommodating space 74. That is, the groove 100 may extend rearward from an end portion of the lamp accommodating space 74. As described above, because the groove 100 extends from the lamp accommodating space 74, the groove 100 may be more effectively hidden from the user's field view when the lamp 71 disposed in the lamp accommodating space 74 emits light.

The upper plate 21 may further include a rear lamp accommodating space 59 located behind the lamp accommodating space 54. The rear lamp accommodating space 59 may be provided in plurality on the left and right. A rear lamp 78 may be placed in the rear lamp accommodating space 59. A lower side, which is open, of the rear lamp accommodating space 59 may be covered by a rear lamp cover 79.

Figure 17:
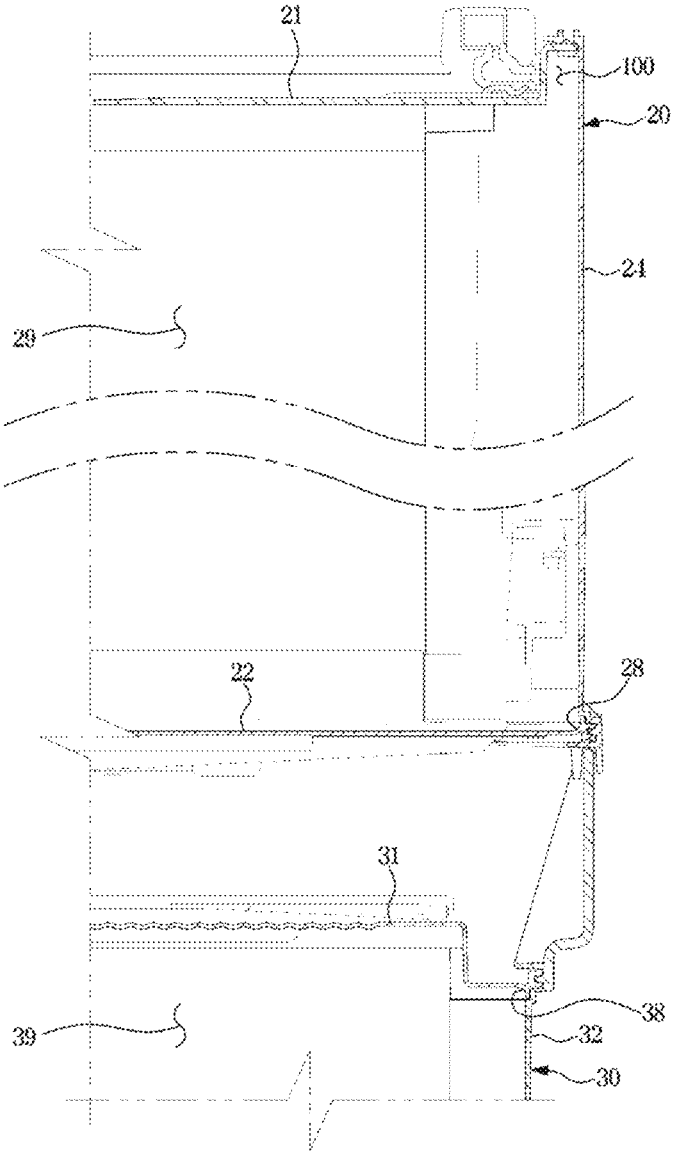
FIG. 17 is a front cross-sectional view of the refrigerator one or more embodiments.

FIG. 17 is a front cross-sectional view of the inner case according to one or more embodiments.

Referring to FIG. 17, as described above, the inner cases 20 and 30 may include the first inner case 20 disposed in the upper portion and the second inner case 30 disposed in the lower portion. The groove 100 may be formed between the upper plate 21 and the right plate 24 of the first inner case 20 so as to conceal the coupling line between the upper plate 21 and the right plate 24. Further, the groove 100 may be formed between the upper plate 21 and the left plate of the first inner case 20.

On the other hand, groove may not be formed between the lower plate 22 and the right plate 24 of the first inner case 20 and between the lower plate 22 and the left plate of the first inner case 20. Further, the coupler between the lower plate 22 and the right plate 24 of the first inner crate 20 and the coupler between the lower plate 22 and the left plate of the first inner case 20 may include a round portion 28 formed to be round so as to prevent a liquid material, which is leaked into the storage compartment 29, from accumulating therein.

The groove may not be formed between the upper plate 31 and the right plate 32 of the second inner case 30 and between the upper plate 31 and the left plate. Because the second inner case 30 is located in the lower portion of the main body 10, a gap between the upper plate 31 and the right plate 32 of the second inner case 30 and a gap between the upper plate 31 and the left plate may be hardly exposed to the user's field of view. The coupler between the lower plate 31 and the right plate 32 of the second inner case 30 and the coupler between the lower plate 31 and the left plate of the second inner case 30 may include a round portion 38.

Figure 18:
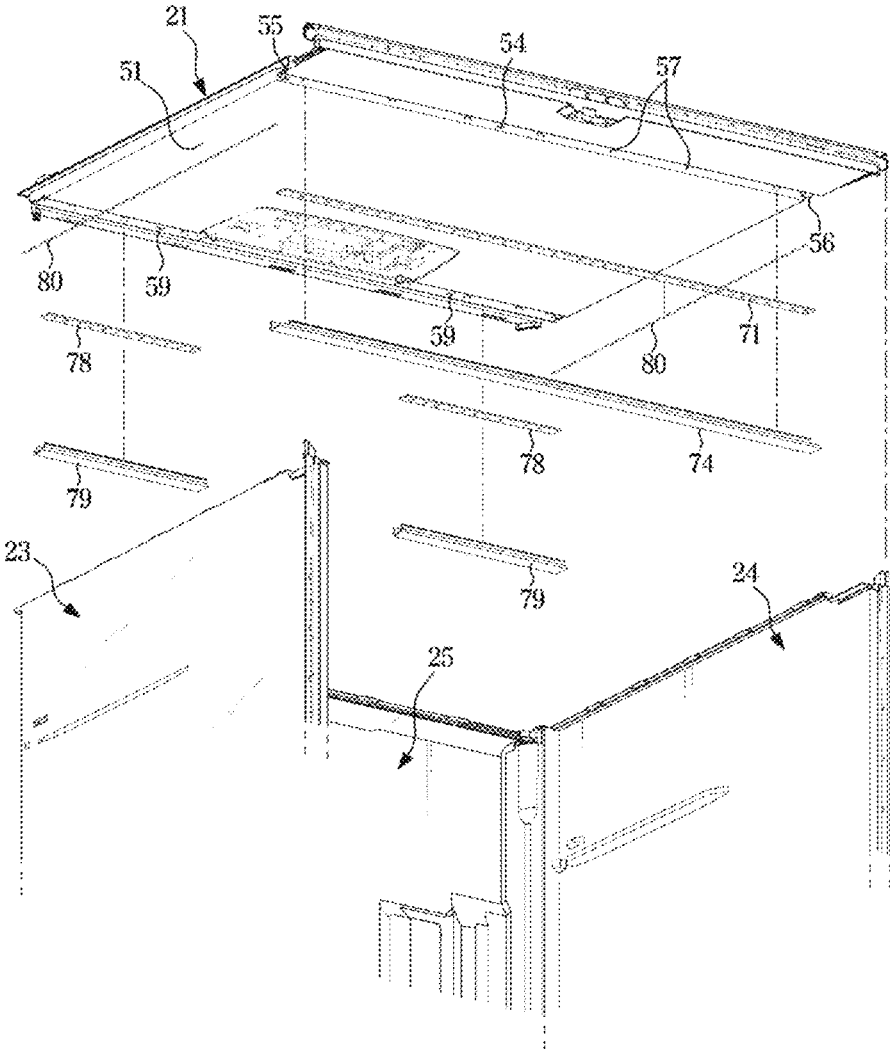
FIG. 18 is a view illustrating a lamp mounting structure one or more embodiments.
Figure 19:
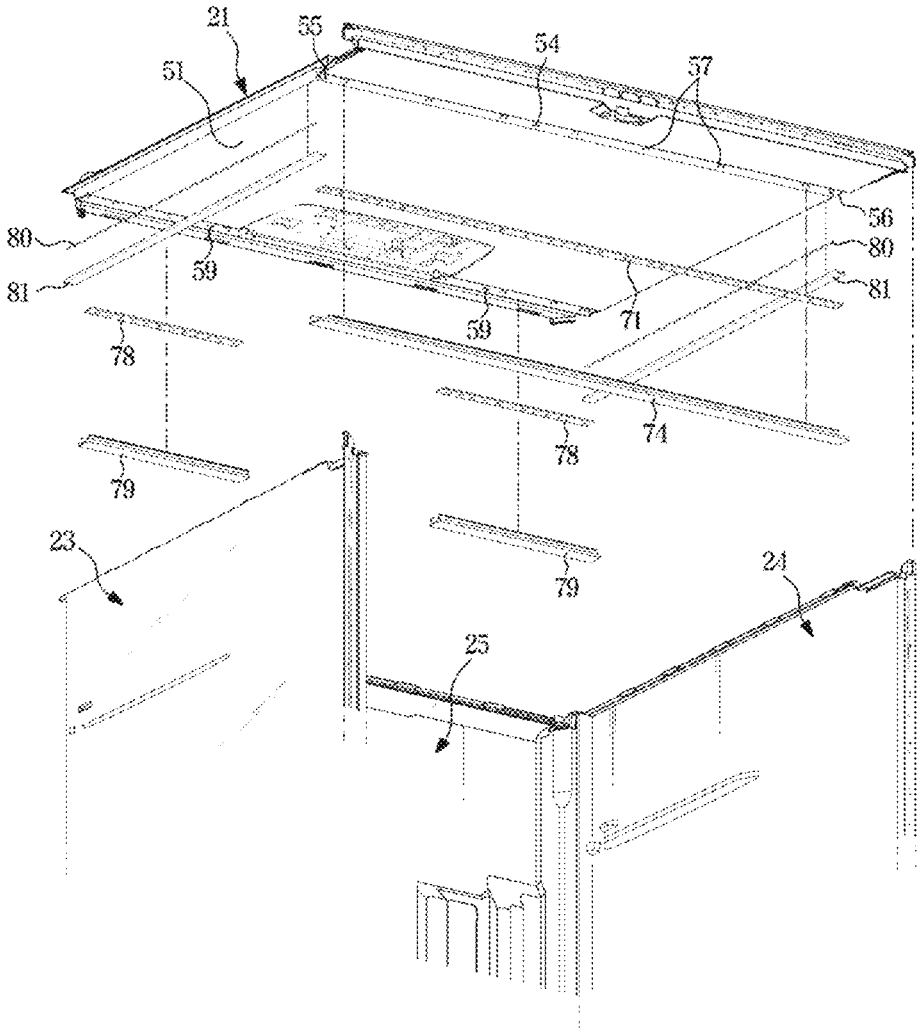
FIG. 19 is a view illustrating a lamp mounting structure one or more embodiments.

FIG. 18 is a view illustrating a lamp mounting structure one or more embodiments. FIG. 19 is a view illustrating a lamp mounting structure according to one or more embodiments.

A lamp mounting structure one or more embodiments will be described with reference to FIG. 18. A description of the same configuration as the above-described embodiment may be omitted.

The refrigerator may further include a side lamp 80 in addition to the lamp 71 and the rear lamp 78 of the above-described embodiment. The side lamp 80 may be provided on the upper left and upper right sides of the storage compartment 29 to illuminate the storage compartment 29.

Particularly, the side lamp 80 may be disposed inside the groove 100 described above. The side lamp 80 may be arranged long in the front and rear direction along the groove 100. The side lamp 80 may include a light source such as an LED and a substrate on which the light source is mounted. The side lamp 80 may be attached to the upper plate 21 or the lateral plates 23 and 24.

The side lamp 80 may be provided in plurality, and the plurality of side lamps may be disposed in the left groove 100 and the right groove 100, respectively. With this configuration, the lamp may be arranged in a square shape on the inner surface of the upper plate 21 and may evenly illuminate the entire storage compartment 29.

Referring to FIG. 19, a lamp cover 81 may be attached to the groove 100 to cover the open lower side of the groove 100.

The lamp cover 81 may protect the side lamp 80 disposed in the groove 100. The lamp cover 81 may form a portion of the upper portion of the storage compartment 29. The lamp cover 81 may be coupled to the upper plate 21. The lamp cover 81 may include a cover body forming the same plane as the inner surface 51 of the upper plate 21, and a cover protrusion protruding from the cover body toward the groove 100. The cover body may be formed of a transparent, translucent or fluorescent material to allow light emitted from the side lamp 80 to pass through. The cover protrusion may be coupled to a mounting protrusion (not shown) formed in the groove 100. The side lamp 80 may be attached to the lamp cover 81 or one surface of the groove 100.

While the disclosure has been illustrated and described with reference to one or more embodiments, it will be understood that the one or more embodiments are intended to be illustrative, not limiting. It will be further understood by those skilled in the art that various changes in form and detail may be made without departing from the true spirit and full scope of the disclosure, including the appended claims and their equivalents. It will also be understood that any of the embodiments described herein may be used in conjunction with any other embodiments described herein.

What is claimed is:

1. A refrigerator comprising:

an inner case forming a storage compartment with an open front side, the inner case comprising a plurality of plates;

an outer case coupled to an outside of the inner case; and an insulation material between the inner case and the outer case, wherein the plurality of plates comprises an upper plate and a lateral plate coupled to the upper plate, wherein the upper plate comprises an upper plate body and an upper plate coupler on an edge of the upper plate body, wherein the lateral plate comprises a lateral plate body and a lateral plate coupler on an edge of the lateral plate body, the lateral plate coupler configured to be coupled to the upper plate coupler, wherein the upper plate coupler comprises an upward extension portion extending upward from the upper plate body and spaced from the lateral plate body by a predetermined distance, wherein the inner case comprises a groove recessed upward and extending in a front and rear direction between the upward extension portion and the lateral plate body, and wherein the upper plate coupler and the lateral plate coupler are above the groove while the upper plate and the lateral plate are coupled.

2. The refrigerator of claim 1, wherein the groove extends rearward from a first point, the first point being spaced in a rear direction from a front surface of the inner case by a first predetermined length.

3. The refrigerator of claim 2, further comprising a section between the front surface of the inner case and a second point, the second point being spaced in the rear direction from the front surface of the inner case by a second predetermined length, wherein the upper plate body and the lateral plate body contact each other at the section, and wherein an angle is formed between the upper plate body and the lateral plate body at the section.

4. The refrigerator of claim 3, wherein the upper plate comprises a lamp accommodating space recessed on an inner surface of the upper plate and configured to accommodate a lamp, and wherein the lamp accommodating space is formed between the first point and the second point.

5. The refrigerator of claim 4, wherein a left side of the lamp accommodating space and a right side of the lamp accommodating space are open.

6. The refrigerator of claim 5, wherein the lateral plate is one from among a left plate and a right plate, wherein the plurality of plates further comprises the other from among the left plate and the right plate, and wherein the left side of the lamp accommodating space is covered by the left plate, and the right side of the lamp accommodating space is covered by the right plate.

7. The refrigerator of claim 5, wherein the groove and the lamp accommodating space are connected to each other.

8. The refrigerator of claim 5, wherein a lower side of the lamp accommodating space is open, and wherein the refrigerator further comprises a lamp cover configured to cover the open lower side of the lamp accommodating space.

9. The refrigerator of claim 8, wherein the lamp cover comprises:

a cover body forming the same plane as the inner surface of the upper plate; and a cover protrusion protruding from the cover body toward the lamp accommodating space, wherein the upper plate comprises a mounting protrusion formed in the lamp accommodating space and configured to allow the cover protrusion to be coupled thereto.

10. The refrigerator of claim 1, wherein the groove is defined by and between a surface of the upward extension portion and a surface of the lateral plate body, and wherein the surface of the upward extension portion and the surface of the lateral plate body face each other, and are spaced apart from each other by the groove.

11. A refrigerator comprising:

an inner case forming a storage compartment with an open front side, the inner case comprising a plurality of plates;

an outer case coupled to an outside of the inner case; and an insulation material between the inner case and the outer case, wherein the plurality of plates comprises an upper plate and a lateral plate coupled to the upper plate, wherein the upper plate comprises an upper plate body and an upper plate coupler on an edge of the upper plate body, wherein the lateral plate comprises a lateral plate body and a lateral plate coupler on an edge of the lateral plate body, the lateral plate coupler configured to be coupled to the upper plate coupler, wherein the upper plate coupler comprises an upward extension portion extending upward from the upper plate body and spaced from the lateral plate body by a predetermined distance, wherein the inner case comprises a groove recessed upward and extending in a front and rear direction between the upward extension portion and the lateral plate body, wherein the upper plate coupler comprises an insertion protrusion protruding from the upward extension portion toward the lateral plate, and wherein the lateral plate coupler comprises an insertion groove into which the insertion protrusion is inserted.

12. The refrigerator of claim 11, wherein the lateral plate coupler comprises an upper protrusion protruding from the lateral plate body toward the upper plate, and a lower protrusion protruding from the lateral plate body toward the upper plate and located below the upper protrusion, and wherein the insertion groove is formed between the upper protrusion and the lower protrusion.

13. The refrigerator of claim 12, wherein the groove comprises:

a depth having a length between an open lower side of the groove and the lower protrusion; and a width having a length between the upward extension portion and the lateral plate body, wherein the depth of the groove is greater than or equal to the width of the groove.

14. The refrigerator of claim 11, wherein the upper plate coupler comprises a locking protrusion protruding from the insertion protrusion in a direction perpendicular to an insertion direction of the insertion protrusion, and wherein the lateral plate coupler comprises a locking portion configured to lock the locking protrusion thereto.

15. The refrigerator of claim 14, wherein the lateral plate coupler comprises:

an elastic bracket on which the locking portion is formed; and one or more slits formed on both sides of the elastic bracket and configured to allow the elastic bracket to be elastically deformed.

16. A refrigerator comprising:

an inner case forming a storage compartment with an open front side, the inner case comprising a plurality of plates;

an outer case coupled to an outside of the inner case; and an insulation material between the inner case and the outer case, wherein the plurality of plates comprises an upper plate and a lateral plate coupled to the upper plate, wherein the upper plate comprises an upper plate body and an upper plate coupler on an edge of the upper plate body, wherein the lateral plate comprises a lateral plate body and a lateral plate coupler on an edge of the lateral plate body, the lateral plate coupler configured to be coupled to the upper plate coupler, wherein the upper plate coupler comprises an upward extension portion extending upward from the upper plate body and spaced from the lateral plate body by a predetermined distance, wherein the inner case comprises a groove recessed upward and extending in a front and rear direction between the upward extension portion and the lateral plate body, and wherein the refrigerator further comprises a side lamp arranged inside the groove and configured to illuminate the storage compartment.

17. A refrigerator comprising:

an inner case forming a storage compartment with an open front side, the inner case comprising a plurality of plates;

an outer case coupled to an outside of the inner case; and an insulation material between the inner case and the outer case, wherein the plurality of plates comprises an upper plate and a lateral plate coupled to the upper plate, wherein the upper plate comprises an upper plate body and an upper plate coupler on an edge of the upper plate body, wherein the lateral plate comprises a lateral plate body and a lateral plate coupler on an edge of the lateral plate body, the lateral plate coupler configured to be coupled to the upper plate coupler, wherein the upper plate coupler comprises an upward extension portion extending upward from the upper plate body and spaced from the lateral plate body by a predetermined distance, wherein the inner case comprises a groove recessed upward and extending in a front and rear direction between the upward extension portion and the lateral plate body, wherein the groove extends rearward from a first point, the first point being spaced in a rear direction from a front surface of the inner case by a first predetermined length, wherein the refrigerator further comprises comprising a section between the front surface of the inner case and a second point, the second point being spaced in the rear direction from the front surface of the inner case by a second predetermined length, wherein the upper plate body and the lateral plate body contact each other at the section, and wherein an angle is formed between the upper plate body and the lateral plate body at the section.

* * * * *